United States Patent [19]

Markham

[11] 4,266,488

[45] May 12, 1981

[54] RELOCKING DEVICE FOR SAFES AND THE LIKE

[75] Inventor: Michael H. Markham, Rexdale, Canada

[73] Assignee: Chubb Industries Ltd., Brampton, Canada

[21] Appl. No.: 134,055

[22] Filed: Mar. 26, 1980

Related U.S. Application Data

[63] Continuation-in-part of Ser. No. 974,354, Dec. 29, 1978, abandoned.

[51] Int. Cl.[3] ..... E05G 1/04

[52] U.S. Cl. ..... 109/59 R; 70/1.5; 292/153

[58] Field of Search ..... 109/30, 58, 59, 64; 70/1.5; 292/153; 192/45

[56] References Cited

U.S. PATENT DOCUMENTS

| | | | |
|---|---|---|---|
| 1,568,740 | 1/1926 | Kinnear | 70/1.5 |
| 2,425,262 | 8/1947 | Newton | 70/1.5 |
| 2,947,160 | 8/1960 | Wolters | 70/1.5 |
| 3,746,136 | 7/1973 | Marola | 192/45 |

FOREIGN PATENT DOCUMENTS

| | | | |
|---|---|---|---|
| 233972 | 12/1909 | Fed. Rep. of Germany | 70/1.5 |
| 770431 | 3/1957 | United Kingdom | 109/59 |

*Primary Examiner*—David H. Corbin
*Attorney, Agent, or Firm*—Ridout & Maybee

[57] ABSTRACT

A relocking mechanism for a safe or like security closure comprises one or more relocking devices mounted on a panel of the closure rearwardly of the main bolt and operable to prevent retraction of the bolt. Each of the relocking devices includes a mounting plate carrying a pair of unidirectional hinges constituted by roller clutches, a plate-like bolt-engaging member being connected to the hinges for uni-directional pivotal movement from a disengaging position to bolt-engaging position. The bolt-engaging member is resiliently biassed towards the bolt-engaging position but is normally retained in the disengaging position by a control element which releases the member in the event of forcible attack on the closure.

10 Claims, 7 Drawing Figures

RELOCKING DEVICE FOR SAFES AND THE LIKE

FIELD OF THE INVENTION

This application is a continuation-in-part of my copending U.S. Patent application Ser. No. 974,354, filed Dec. 29, 1978, now abandoned and entitled "Relocking Device for Safes and the like.

This invention relates to relocking mechanisms for the doors of safes, vaults, strong rooms, and like security closures, herein referred to as safes. A safe door locking mechanism typically comprises an elongated bolt mounted for reciprocation in a direction transverse to its length between a forward locking position and a rearward unlocking position, bolt-operating means usually including a handle on the outside of the door, and locking means operable to secure the bolt in its forward locking position. The locking means may take the form of one or more combination locks. Additional security may be provided by means of a relocking mechanism which is normally retained in a waiting condition but, in the event of forcible attack on the locking means, becomes operable to secure the bolt in its forward locking position.

BACKGROUND OF THE INVENTION

Relocking devices in current use are normally based on a construction which employs a round plunger or bolt. The bolt is normally held in the inoperative or waiting condition by some form of constraining means attached either directly or indirectly to the locking means or locking points. When the locking means or locking points are attached the constraining means is released and the relocking device is triggered into the locked position and hence dogs or "relocks" the master boltwork into its locked condition making it much more difficult to defeat the security closure.

In a well planned attack against a safe door or like security closure an attempt will be made to nullify the relocking mechanism by such methods as pinning back the relocking bolt or burning the end of it away with oxy-acetylene equipment. In some cases the relocking mechanism is allowed to trigger, and after the attack on the main locking mechanism is complete the relocking bolt is "fished" back by suitable probing tools to allow the door to be opened.

If the size or engagement of the relocking device is nor very substantial, then the device becomes very susceptible to being burnt away by a thermal attack, and indeed such devices can be defeated in a very short time by the use of a thermic lance. To be effective a relocking device ought to be of a design which permits a considerable length of engagement with the main boltwork and which also makes it very difficult to "fish"the relocking bolt back to the inoperative position.

SUMMARY OF THE INVENTION

According to the present invention there is provided in combination with a safe or like security closure having an elongated bolt mounted for reciprocation in a direction transverse to its length between a forward locking position and a rearward unlocking position, a relocking mechanism comprising a bolt-engaging member mounted on the closure rearwardly of the bolt, the member being mounted for unidirectional movement from a first position in which it is disengaged from the bolt to a second position in which it is engageabale with the bolt to prevent retraction of the bolt to the rearward unlocking position, the bolt-engaging member being biassed towards its second position and normally being retained in its first position by a control element including means responsive to forcible attack on the closure for releasing the bolt engaging member.

In a preferred embodiment of the invention, the relocking mechanism includes a mounting plate mounted on a panel of the closure, the mounting plate carrying a pair of unidirectional hinges constituted by roller cluthes, the bolt-engaging member being pivotally connecting to the mounting plate by the hinges for pivotal movement in said one direction only. The bolt-engaging member may be biassed by means of a spring mounted between and engaging the mounted plate and the bolt-engaging member.

BRIEF DESCRIPTION OF THE DRAWINGS

A preferred embodiment of the invention will now be described by way of example, with reference to the accompanying drawings in which.

DESCRIPTION OF THE PREFERRED EMBODIMENT

Figure 1:
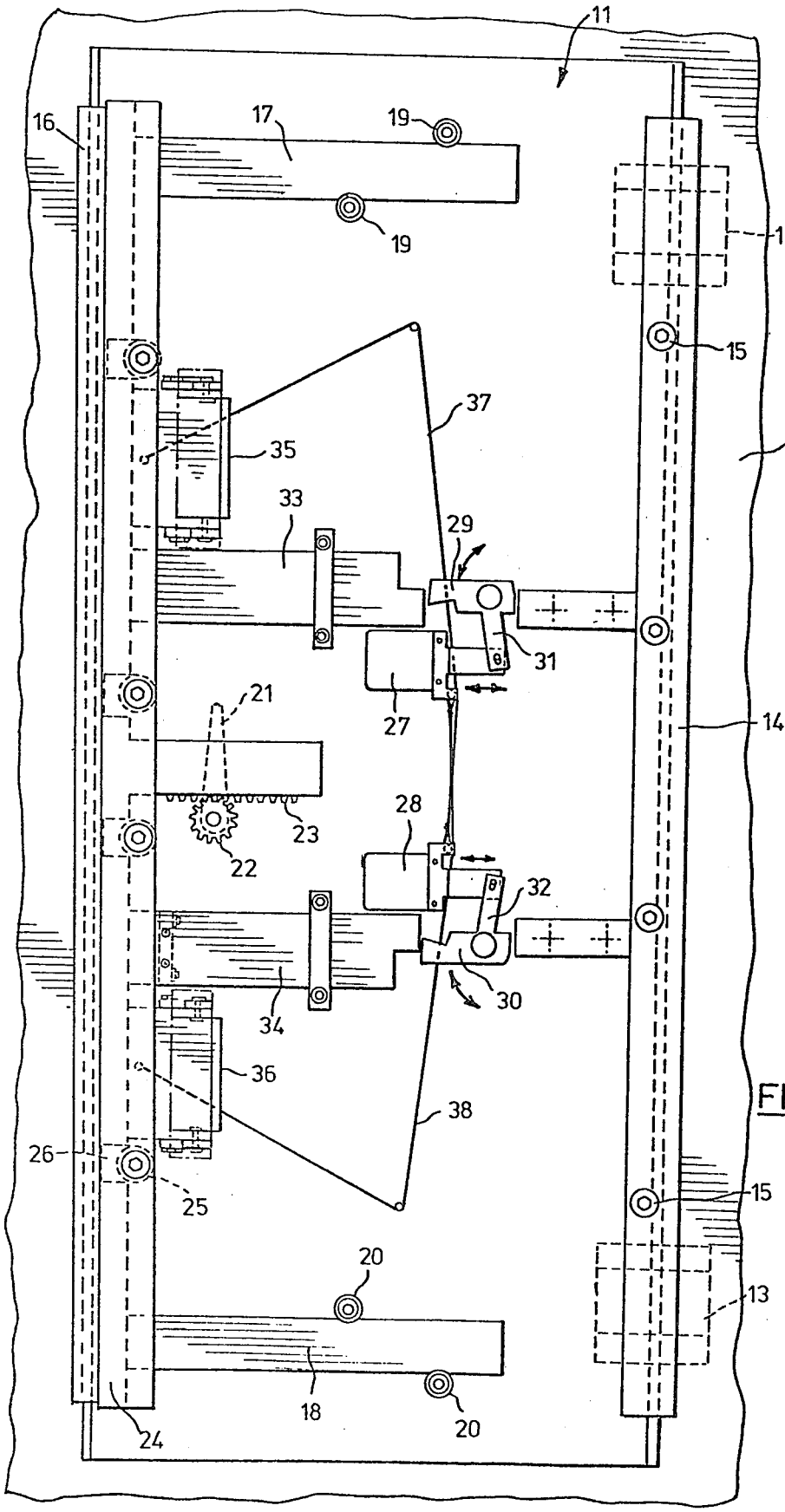
FIG. 1 is a rear elevational view of a safe door, the inside panel of the door having been removed to expose the internal mechanisms.

FIG. 1 shows part of the wall structure 10 of a safe with a door 11 mounted thereon by hinges 12, 13 for closing a rectangular access opening. At the hinged side of the door a reinforcing bar 14 is bolted by bolts 15. The main boltwork of the door includes an elongated bolt 16 extending along most of the vertical edge of the door, the bolt being mounted for sliding reciprocatory movement in a direction transverse to its length between a forward locking position, as shown in FIG. 1, and a rearward unlocking position. In the forward locking position the bolt 16 engages in a cooperating recess in the wall structure in the conventional way. The bolt 16 is guided for horizontal movement by runner bars 17, 18 which ride on rollers 19, 20. A handle 21 is provided on the outside of the door for operating the bolt 16 through a pinion 22 and ratchet 23. A retainer bar 24 bolted to the main door panel by bolts 25 extends over the inner side of the bolt 16 to retain the bolt against forcible displacement from the outside, the rear edge of the bolt being recessed as shown at 26 to accommodate the securing bolts 25 when the bolt 16 is retracted.

The primary locking mechanism of the door includes a pair of combination locks 27, 28 which operate pivoted blocking elements 29, 30 through links 31, 32. It will be appreciated that some such locking mechanisms may have just one combination lock with associated locking means, while others may include more than two combination locks with associated locking means; the illustrated locking mechanism with twin locks is merely an example. The blocking elements 29, 30 abut against the ends of bars 33, 34 extending rearwardly from bolt 16, as shown in FIG. 1, but when the door is unlocked the blocking elements are pivoted away from the bars 33, 34 to permit retraction of the door by operation of the handle 21.

The part of such a door which is usually most vulnerable to forcible attack, whether by mechanical tools or a thermic lance, is the region at which the locking devices 27, 29 and 28, 30 are located. If these devices are removed or sufficiently displaced the main bolt can be retracted by the handle. To provide additional security in the event of forcible attack on the door it is usual to provide a relocking mechanism which, in the event of such attack, is triggered to secure the main bolt.

In the illustrated embodiment of the invention the relocking mechanism comprises a pair of relocking devices 35, 36 mounted on the main panel of the door 11 rearwardly of the bolt 16. These devices are coupled to the twin locking devices of the primary locking mechanism by control elements in the form of flexible straps or cables 37, 38, the control elements being arranged to retain the relocking devices in an inoperative condition but being released to trigger the relocking devices in the event of forcible attack, more particularly in the region of the door at which the primary locking devices are located.

Figure 2:
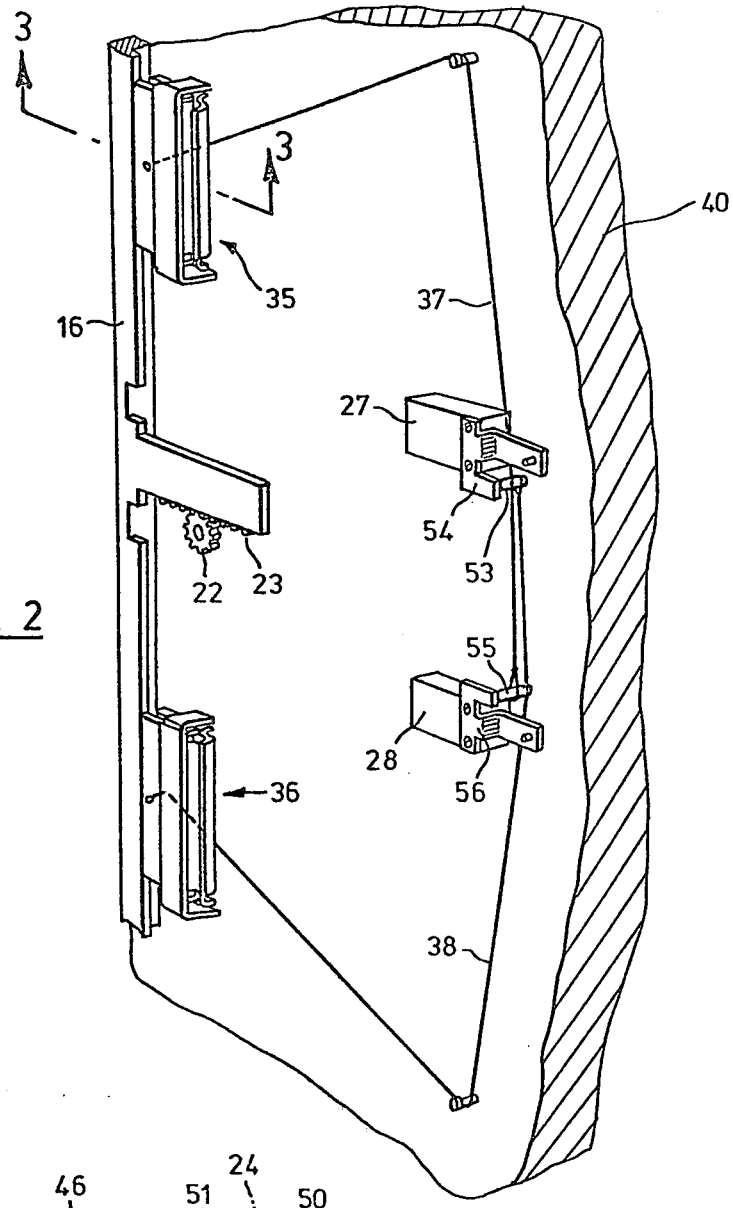
FIG. 2 is a simplified view of a fragment of the door and showing in particular the relocking mechanism.
Figure 3:
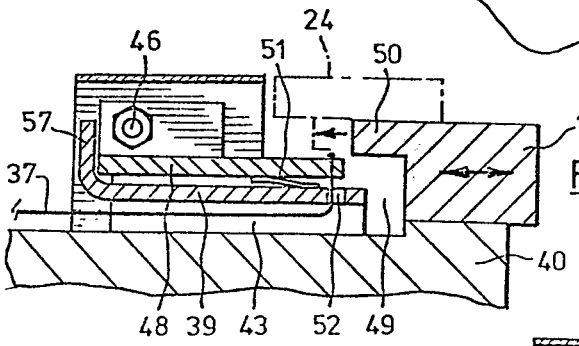
FIG. 3 is a section taken on line 3—3 of FIG. 2 showing one of the relocking devices in section.
Figure 4:
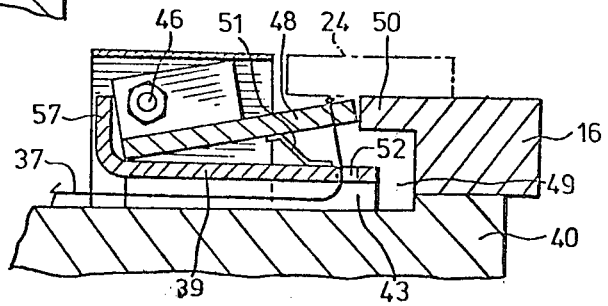
FIG. 4 is a view corresponding to FIG. 3 but showing the relocking device in the triggered condition.
Figure 5:
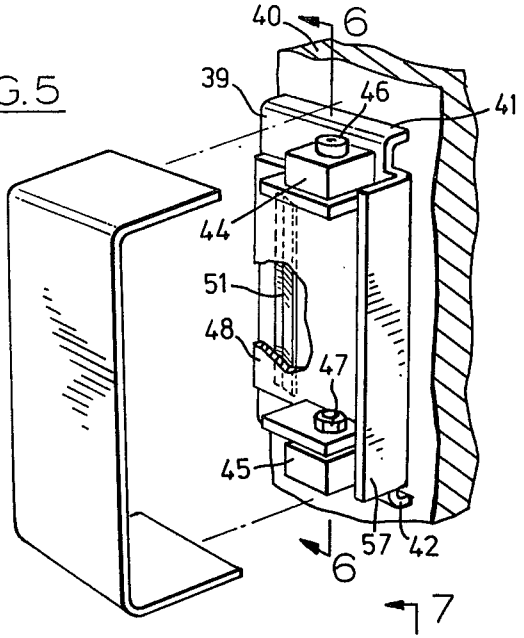
FIG. 5 is an exploded perspective view of one of the relocking devices, part of the device being broken away to expose a hidden part.

The relocking mechanism is illustrated in greater detail in FIGS. 2 to 5, to which reference will now be made. Each of the relocking devices 35, 36 comprises a mounting plate 39 mounted on the main panel 40 of the door at a suitable position immediately rearward of the main bolt 16. As shown in FIG. 2, the two relocking devices are spaced longitudinally with respect to the bolt 16. The mounting plate has a pair of downturned side flanges 41, 42 which define a space 43 between the mounting plate and the door plate. In addition the mounting plate has a pair of upturned side flanges 44, 45 which carry unidirectional hinges constituted by roller clutches 46, 47. A bolt-engaging member 48 formed by a stiff plate is connected to the mounting plate 39 by the hinges 46, 47 so as to be pivotally movable in one direction only from a first, inoperative position as shown in FIG. 3 to a second, blocking position as shown in FIG. 4. The rear edge of the bolt 16 is stepped to define an elongate recess 49 which, when the bolt-engaging member 48 is in its first, inoperative position, can accommodate the member and so permit retraction of the bolt 16. When the member 48 is in its second, blocking position, as shown in FIG. 4, it is positioned to abut against the elongate step 50 on the rear edge of the bolt and so prevent retraction of the bolt. The mounting plate 39 also has an angled rear edge portion 57 positioned to abut against a rear edge of the bolt-engaging member 48 if the latter member is forcibly displaced rearwardly.

The bolt-engaging member 48 is resiliently biassed towards the second position by a leaf spring 51 located between the mounting plate 39 and the member 48. It is, however, normally held in the first position against the bias of the spring by the respective strap or cable 37 or 38. Each of these straps or cables engages means responsive to forcible attack on the door located in the region of the primary locking devices so as to release the associated bolt-engaging member in the event of such attack. Thus, for example, the strap or cable 37 is connected to the bolt-engaging member 48 and passes through a hole 52 in the mounting plate 39 into the space 43. The strap or cable passes round a pin 53 extending from a bracket 54 mounted on the casing of the combination lock 27, and is anchored at its end to a pin 55 similarly extending from a bracket 56 mounted on the casing of the other combination lock 28. The other strap or cable 38 is similarly connected. Thus, each of the control elements engages both pins 53, 55 so that if either pin is displaced in the event of forcible attack on the primary locking mechanism both control elements will become slack. Normally, of course, these control elements are held taut by their engagement with both pins and so retain the bolt-engaging members of the relocking devices in their respective first positions. On becoming slack the straps or cables release the bolt-engaging members which are thereupon urged by their respective leaf springs to the relocking position. Once the relocking devices have been triggered they cannot easily be "fished" back by probing tools, since their return movement is prevented by the unidirectional hinges.

As stated above, the unidirectional hinges are constituted by roller clutches, which are commercially available devices incorporating roller bearings and wedges so arranged as to transmit torque in one direction while allowing overrun in the opposite direction. Such a device is disclosed, for example, in U.S. Pat. No. 3,746,136 to Americo E. Marola et al dated July 17, 1973 and entitled "Unidirectional Clutch", the disclosure of which is incorporated herein by reference. Such devices have a variety of applications, and in the present instance are used as unidirectional hinges for allowing pivotal movement of the bolt-engaging members 48 in a one direction only. The roller clutches used in the preferred embodiment of the invention are Tpe DC roller clutches manufactured by The Torrington Company, of Torrington, Conn.

Figure 7:
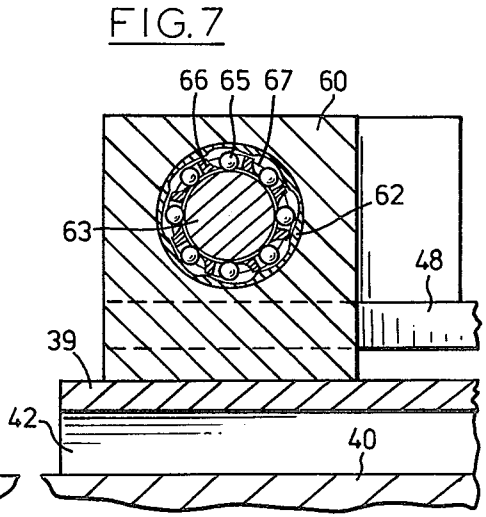
FIG. 7 is a section on line A—A in FIG. 6.
Figure 6:
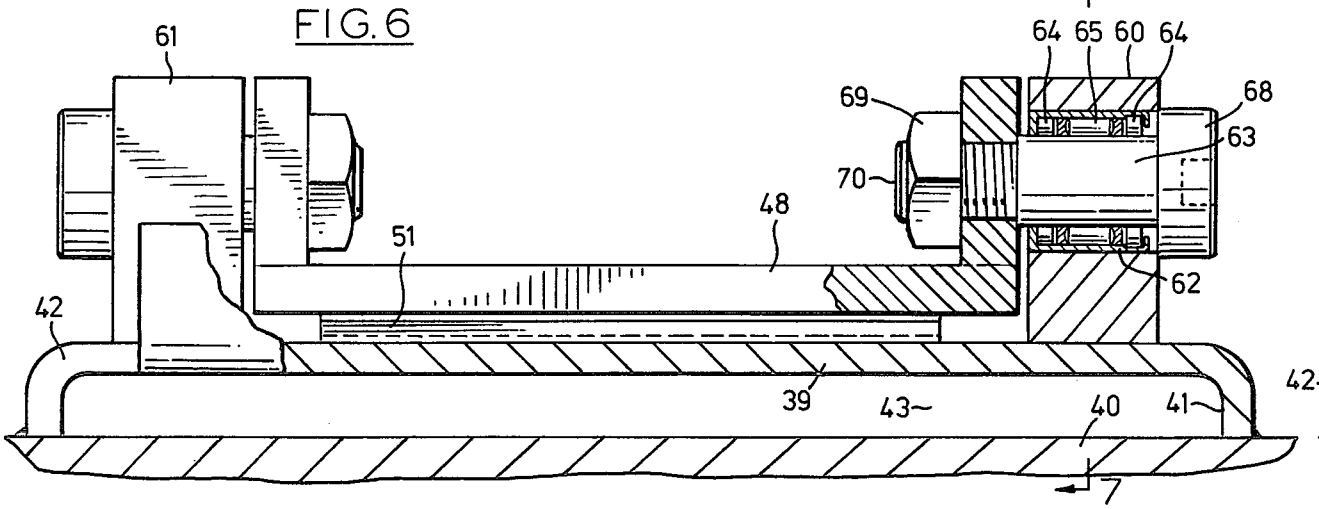
FIG. 6 shows a detail of one of the relocking devices, this view being an enlarged sectional view taken on the axis of one of the roller clutches.

FIGS. 6 and 7 illustrate a detail of one of the relocking devices, 35, one of the unidirectional hinges being shown in section. The mounting plate 39 is welded to the door panel 40 by its side flanges 41, 42, there being a space 43 between the mounting plate and the door. A pair of mounting blocks 60, 61, serving as bearing supports are welded to the mounting plate 39 and house the unidirectional hinges which are axially aligned. As shown, each mounting block has a cylindrical bore which accommodates the respective roller clutch, the latter having an outer housing 62 which is a press fit in the bore so that it cannot rotate. A central shaft 63, serving as a pivot, is located within the clutch housing 62 by bearing rollers 64. Rotation of the shaft 63 in one direction is permitted by an assembly of clutch rollers 65 carried by a cage 66. However, rotation of the shaft 63 in the opposite direction is prevented by wedging of the rollers 65 between locking ramps on the cage and on the inside of the clutch housing 62, the wedging action being assisted by stainless steel leaf springs 67. The shaft 63 is located axially by an enlarged portion 68 which bears against one side of the mounting block 60, or 61, and by a screw 69 which engages a threaded extension 70 of the shaft and fastens it to a carrier flange 71 of the bolt-engaging member 48.

As will be appreciated, other means responsive to forcible attack on the primary locking mechanism may be used instead of, or as well as, the strap and pin configurations illustrated in the drawings. For example, control element in the form of a strap or cable may include a thermic link which fuses in response to thermal attack, or may be anchored to a frangible plate which shatters in response to mechanical attack.

Furthermore, although in the preferred embodiment of the invention described above the unidirectional hinges 46, 47 are constituted by roller clutches of a particular type, it is to be understood that such roller clutches are but an example of means for mounting the bolt-engaging member 48 so that it can move in one direction only from a bolt-disengaging position to a bolt-engaging position.

What I claim is:

1. In a safe or like security closure:

an elongated bolt mounted for reciprocation in a direction transverse to its length between a forward locking position and a rearward unlocking position, bolt-operating means therefor, locking means operable to lock the bolt in its forward position, and relocking means for said bolt, the relocking means comprising:

a bolt-engaging member mounted on said closure rearwardly of the bolt, the member being pivotally connected to the closure by at least one unidirectional hinge for unidirectional pivotal movement from a first position in which it is disengaged from the bolt to a second position in which it is engageable with the bolt to prevent retraction of the bolt to the rearward unlocking position, said unidirectional hinge including means permitting pivotal movement of the bolt-engaging member in one direction only, means biassing the bolt-engaging member towards said second position, a control element connected to the bolt-engaging member, said control element normally being held in retaining condition for retaining the bolt-engaging member against said biassing means in said first position, and means responsive to forcible attack on the closure for releasing the bolt-engaging member.

2. The combination claimed in claim 1, including a mounting plate mounted on a panel of the closure, the mounting plate carrying a pair of said unidirectional hinges, said hinges being constituted by roller clutches, the bolt-engaging member being pivotally connected to the mounting plate by said hinges for pivotal movement in one direction only.

3. The combination claimed in claim 1, wherein the control element consists of a flexible strap engaging said means responsive to forcible attack and held taut thereby in its retaining condition.

4. The combination claimed in claim 3, said means responsive to forcible attack being located in the region of said locking means.

5. The combination claimed in claim 4, said bolt having a stepped rear edge defining a recess to accommodate the bolt-engaging member in its first position for permitting retraction of the bolt and a step to abut against the bolt-engaging member in its second position for preventing retraction of the bolt.

6. A locking mechanism for a safe or like security door comprising:

an elongated bolt mounted for reciprocation in a direction transverse to its length between a forward locking position and a rearward unlocking position, bolt-operating means therefor, locking means operable to lock the bolt in its forward position, and relocking means for said bolt, the relocking means comprising:

a pluralitly of bolt-engaging members mounted on the door rearwardly of the bolt at longitudinally spaced locations, each of said members being pivotally connected to the door by at lest one unidirectional hinge for unidirectional pivotal movement from a first position in which it is disengaged from the bolt to a second position in which it is engageable with the bolt to prevent retraction of the bolt to the rearward unlocking position, said unidirectional hinge including means permitting pivotal movement of the bolt-engaging member in one direction only, means resiliently biassing the bolt-engaging members towards their respective second positions, a plurality of control elements connected to the bolt-engaging members, said control elements normally being held in retaining condition for retaining the bolt-engaging members against said biassing means in their respective first positions, and means responsive to forcible attack on thedoor located in the region of said locking means, said means responsive to forcible attack normally engaging the control elements to hold them in retaining condition and being operable to release the control elements in response to forcible attack on the door in the region of said locking means.

7. A locking mechanism as claimed in claim 6, wherein the bolt has a stepped rear edge defining an elongate recess to accommodate the bolt-engaging members in their first position to permit retraction of the bolt, and an elongate step to abut against the bolt-engaging members in their second position for preventing retraction of the bolt.

8. A locking mechanism as claimed in claim 6, including a plurality of said locking means, wherein said means responsive to forcible attack includes a plurality of pins mounted on the door in the regions of said locking means, said control elements consisting of flexible straps anchored to the pins, each strap engaging all said pins and being held in retaining condition by such engagement, whereby displacement of any one of said pins effects release of all the straps.

9. A locking mechanism as claimed in claim 6, said relocking means including for each bolt-engaging member a mounting plate mounted on the door, the mounting plate carrying a pair of said unidirectional hinges, said hinges being constituted by roller clutches and each bolt-engaging member being pivotally connected to its respective mounting plate by said hinges for pivotal movement in one direction only.

10. A locking mechanism as claimed in claim 9, wherein each mounting plate has an angled edge portion positioned to abut against a rear edge of the respective bolt-engaging member if the member is displaced rearwardly.

* * * * *